US011831100B2

(12) United States Patent
Ota et al.

(10) Patent No.: US 11,831,100 B2
(45) Date of Patent: Nov. 28, 2023

(54) TERMINAL STRUCTURE

(71) Applicant: HONDA MOTOR CO., LTD., Tokyo (JP)

(72) Inventors: Hiroaki Ota, Tokyo (JP); Yasunori Mukumoto, Tokyo (JP); Masataka Ohashi, Tokyo (JP); Kotaro Tagami, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/680,655

(22) Filed: Feb. 25, 2022

(65) Prior Publication Data

US 2022/0320791 A1 Oct. 6, 2022

(30) Foreign Application Priority Data

Mar. 31, 2021 (JP) ..... 2021-061484

(51) Int. Cl.
*H01R 4/10* (2006.01)
*H01R 13/52* (2006.01)

(52) U.S. Cl.
CPC ..... *H01R 13/5213* (2013.01); *H01R 4/10* (2013.01)

(58) Field of Classification Search
CPC ..... H01R 13/5213; H01R 4/10; H01R 4/70
See application file for complete search history.

(56) References Cited

U.S. PATENT DOCUMENTS

| | | | | |
|---|---|---|---|---|
| 8,723,040 | B2 * | 5/2014 | Sakura | H01R 13/52 174/72 A |
| 8,951,063 | B2 * | 2/2015 | Iio | H01R 13/5216 439/523 |
| 9,083,100 | B2 * | 7/2015 | Uno | H01R 4/70 |
| 9,287,655 | B2 * | 3/2016 | Sato | H01R 43/005 |
| 9,379,460 | B2 * | 6/2016 | Miyamoto | H01R 4/62 |
| 9,667,011 | B2 * | 5/2017 | Sato | H01R 4/18 |
| 10,594,103 | B2 * | 3/2020 | Steinberg | H01R 43/005 |
| 10,615,517 | B2 * | 4/2020 | Onuma | H01R 43/24 |
| 2011/0070781 | A1 * | 3/2011 | Kitagawa | H01R 4/185 29/863 |
| 2014/0194003 | A1 | 7/2014 | Nabeta | |

FOREIGN PATENT DOCUMENTS

JP 2013-062076 A 4/2013

* cited by examiner

*Primary Examiner* — Tho D Ta
(74) *Attorney, Agent, or Firm* — Rankin, Hill & Clark LLP

(57) ABSTRACT

The terminal structure includes an electric wire including a core wire and a terminal member attached to the electric wire. The terminal member includes a joining portion to which the core wire is joined and the sealing portion surrounding the joining portion and including an opening portion having the joining portion exposed therethrough. The core wire is joined to the joining portion through the opening portion and is in close contact with the sealing portion annularly around the opening portion.

3 Claims, 4 Drawing Sheets

TERMINAL STRUCTURE

CROSS-REFERENCE TO RELATED APPLICATIONS

The present application claims priority under 35 U.S.C. § 119 to Japanese Patent Application No. 2021-061484, filed Mar. 31, 2021, the contents of which are hereby incorporated by reference in their entirety.

BACKGROUND OF THE INVENTION

1. Field of the Invention

The present invention relates to a terminal structure of an electric wire.

2. Description of the Related Art

A terminal member is attached to a terminal of an electric wire in many cases, the terminal member having a shape matching a counterpart terminal to which the terminal is to be connected. The terminal member has an electric contact point with a core wire of the electric wire. When the terminal member and the core wire are made of different types of metals, attachment of water to the contact point may cause electric corrosion. When the electric corrosion occurs, the resistance of the contact point increases and the attachment strength of the terminal member decreases in some cases. Accordingly, when the terminal is to be used in an environment in which water may attach to the contact point, a waterproofing member is separately prepared to surround and seal the terminal member and prevent entrance of water. For example, JP2013-062076A describes a technique of improving a waterproof performance by housing a part of the electric wire and the terminal member in a waterproof cover.

SUMMARY OF THE INVENTION

When the terminal member is housed, the size of the waterproofing member needs to be larger than the terminal member and the size reduction of the entire terminal including the waterproofing member is limited to a certain degree. Moreover, the waterproofing member is provided such that a portion to be connected to the counterpart terminal is exposed. Sealing between the waterproofing member and the terminal member needs to be performed at a boundary with the exposed portion. Accordingly, there are limitations in the shape of the terminal member such as the terminal member being long and the electric wire cannot be freely routed in some cases.

The present invention has been made to solve the aforementioned problems and an object is to reduce the size of waterproofing structure of a terminal and improve a degree of freedom in arrangement of an electric wire.

A terminal structure according to the present invention to solve the aforementioned problems includes an electric wire including a core wire and a terminal member attached to the electric wire. Here, the terminal member includes a joining portion to which the core wire is joined and a sealing portion surrounding the joining portion and including an opening portion through which the joining portion is exposed. The core wire is joined to the joining portion through the opening portion and is in close contact with the sealing portion annularly around the opening portion.

The present invention achieves size reduction of waterproofing structure of a terminal, improves a degree of freedom in arrangement of an electric wire, and reduces the number of members relating to the terminal.

DETAILED DESCRIPTION OF THE EMBODIMENTS

Figure 1A:
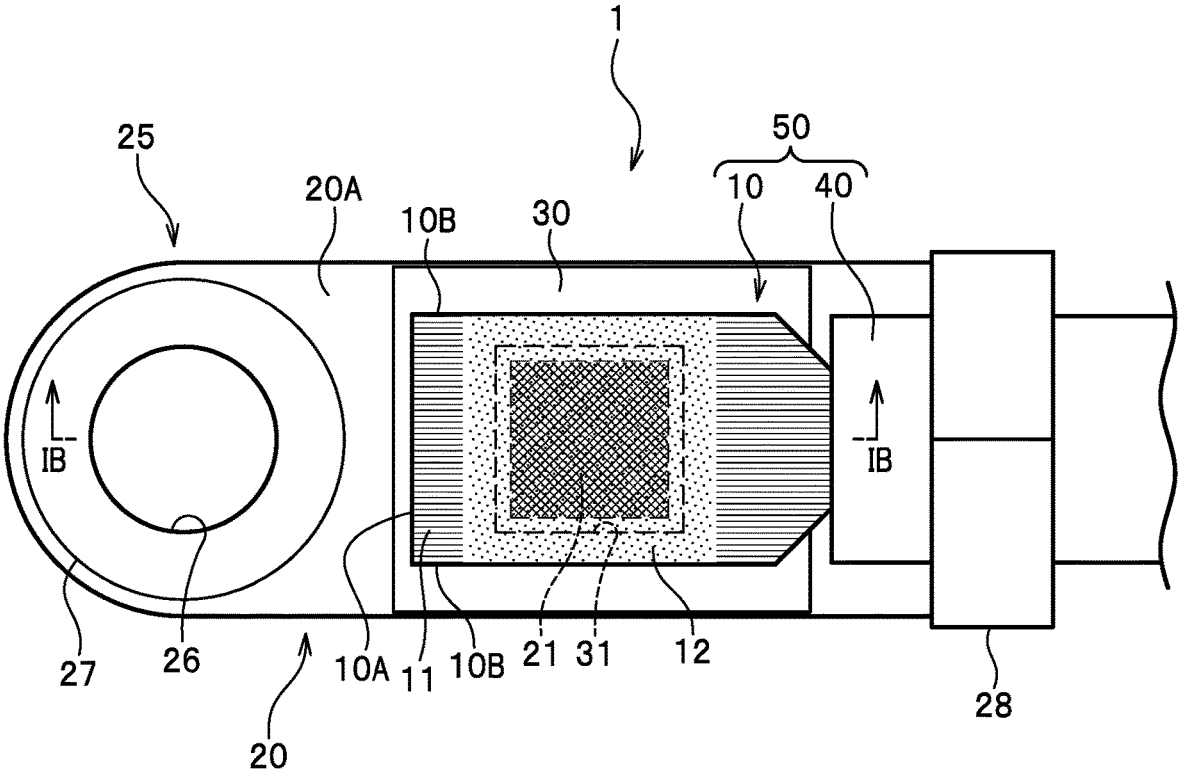
FIG. 1A is a top view of a terminal structure according to an embodiment.
Figure 1B:
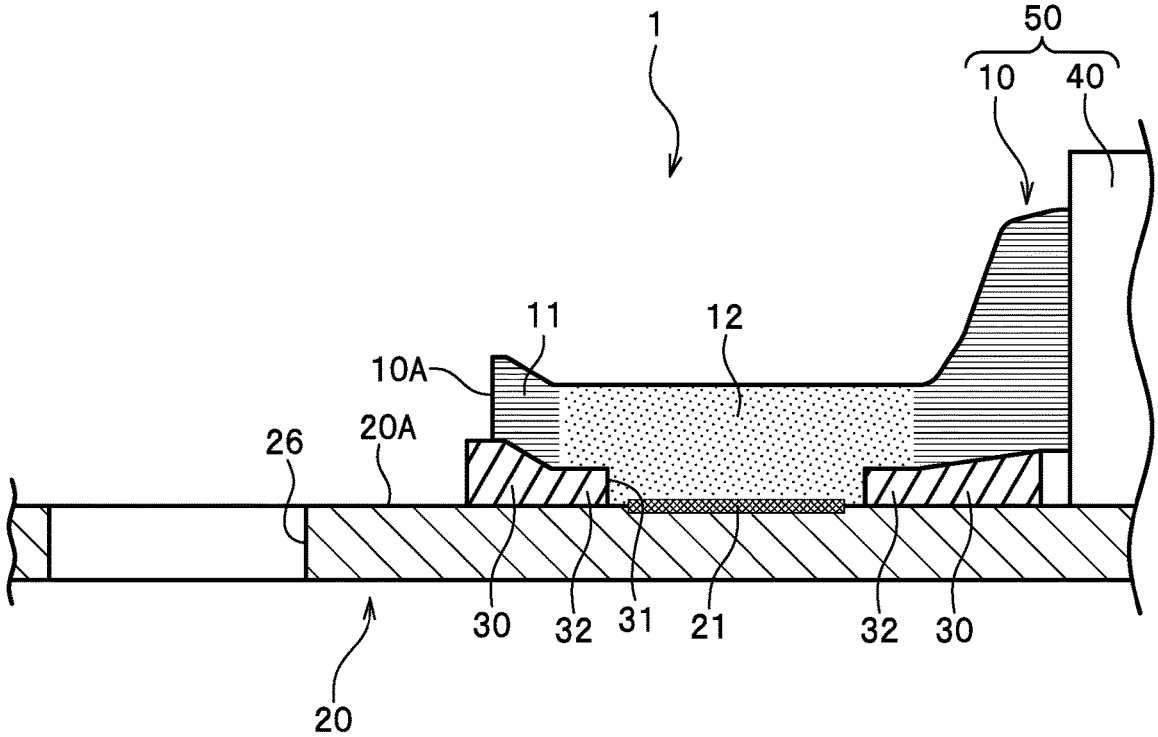
FIG. 1B is a cross-sectional view along the line IB-IB in FIG. 1A.

An embodiment of the present invention is described with reference to the drawings. As illustrated in FIGS. 1A and 1B, a terminal structure 1 according to the embodiment includes a terminal member 20 and an electric wire 50 including a core wire 10.

(Terminal Member)

The terminal member 20 is a member disposed at an end portion of the electric wire 50. The terminal member 20 includes a joining portion 21, a sealing portion 30, and a fitting portion 25. The joining portion 21 and the sealing portion 30 are provided on an arrangement surface 20A on which the core wire 10 of the electric wire 50 is arranged. A material of the terminal member 20 is, for example, a metal.

The fitting portion 25 is a portion to be fitted to a counterpart terminal to which the electric wire 50 is to be connected, and has a shape matching the counterpart terminal. In this example, a through hole 26 is formed in the fitting portion 25 to facilitate fixation with a screw and an annular electrode portion 27 is provided to surround the through hole 26. The shape and material of the electrode portion 27 may be those particularly suitable for connection with the counterpart terminal.

(Joining Portion)

The joining portion 21 is a joined body of the terminal member 20 and the core wire 10. The joining portion 21 fixes and electrically connects the terminal member 20 and the core wire 10 to each other.

The joining portion 21 is formed near a surface of the terminal member 20 surrounded by the sealing portion 30. Although the joining portion 21 has a quadrilateral shape in a top view in this example, the joining portion 21 needs to join only the terminal member 20 and the core wire 10 to each other and may have another shape such as, a circular shape or a polygonal shape.

(Sealing Portion)

Figure 2:
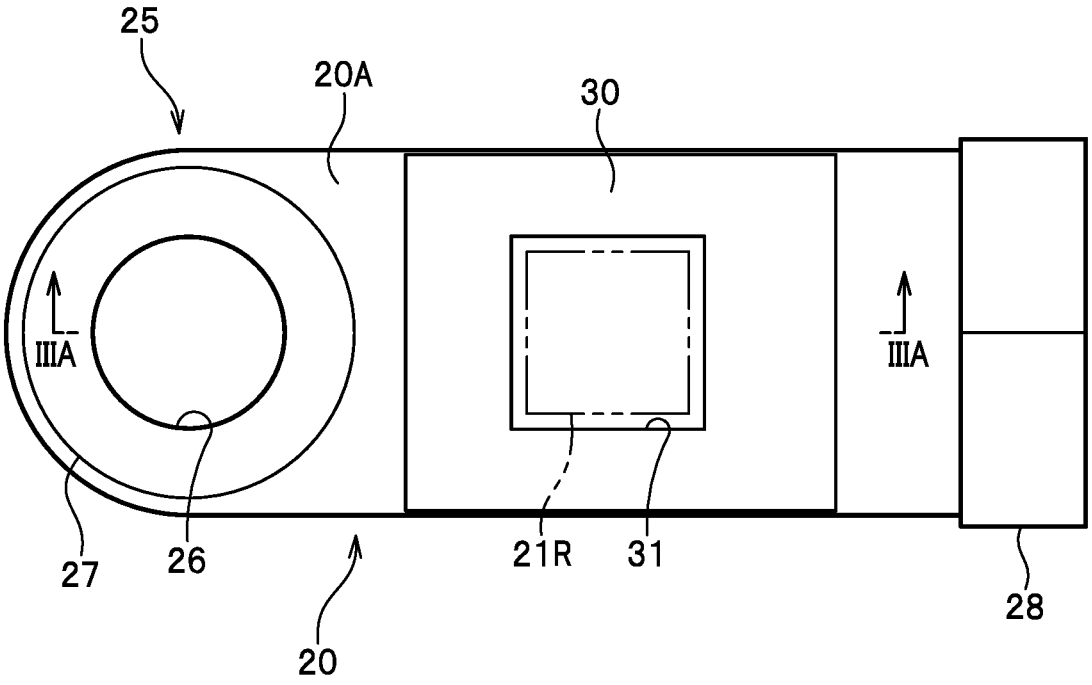
FIG. 2 is a top view illustrating a portion of a terminal member in the terminal structure according to the embodiment.

The sealing portion 30 is a member that is located in a gap between the terminal member 20 and the core wire 10 and that prevents entrance of water. As illustrated in FIG. 2, an opening portion 31 surrounding the joining portion 21 and having the joining portion 21 exposed is formed in the sealing portion 30.

The outer edge of the sealing portion 30 and the opening portion 31 have a quadrilateral shape in the top view. The outer edge of the sealing portion 30 and the opening portion 31 may have another shape such as a circular shape or a polygonal shape, and may have shapes different from each other.

As illustrated in FIG. 1A, the sealing portion 30 has a region that surrounds the opening portion 31 and that overlaps the core wire 10 annularly. As illustrated in FIG. 1B, a part of the region overlapping the core wire 10 annularly is a compressed portion 32 whose thickness from the arrangement surface 20A is smaller than a thickness at the outer edge. The sealing portion 30 is held between the core wire 10 and the terminal member 20 at the position of the compressed portion 32. The sealing portion 30 is in close contact with the core wire 10 annularly around the opening portion 31 and annularly fills a gap between the core wire 10 and the terminal member 20.

The sealing portion 30 may have an elastic property. The sealing portion 30 having the elastic property comes into close contact with the terminal member 20 and the core wire 10 according to the shape of the gap between the terminal member 20 and the core wire 10, and thus improves the waterproof performance of the terminal structure 1.

The sealing portion 30 can be made of an elastic material including, for example, a rubber, acryl, or silicon based elastic sealing material. The sealing portion 30 may be formed of a formed-in-place gasket (FIPG) that is obtained by applying and curing a liquid gasket. Moreover, the sealing portion 30 may be formed by surface treatment with GEOMET (registered trademark) or made of a material with a low elasticity such as a waterproofing coating agent, depending on the material of the core wire 10.

(Fixation Portion)

The terminal member 20 may include a fixation portion 28 used to fix the electric wire 50. The fixation portion 28 holds the electric wire 50 between itself and the arrangement surface 20A. The fixation portion 28 fixes the electric wire 50 to the terminal member 20 at a position away from the joining portion 21 to reduce transmission of external force applied to the electric wire 50 to the joining portion 21, and thus protects the joining portion 21.

(Electric Wire)

The electric wire 50 is a member that is a route of an electric current. The electric wire 50 includes the core wire 10 and a sheath 40. The sheath 40 is an insulating body and covers and protects the core wire 10.

(Core Wire)

The core wire 10 is a linear member including a line of conductive wires 11 twisted together. A material of the core wire 10 is, for example, a metal and may be the same type of metal as the terminal member 20 or a different type of metal. The core wire 10 is joined to the joining portion 21 via the opening portion 31 and is in close contact with the sealing portion 30 annularly around the opening portion 31.

The core wire 10 is arranged on the arrangement surface 20A while holding the sealing portion 30 between itself and the terminal member 20. As illustrated in FIG. 1A, the opening portion 31 is included inside an outer edge of the core wire 10 in the top view. Moreover, outer edges of a front end portion 10A and side surface portions 10B of the core wire 10 are located inside the outer edge of the sealing portion 30. Accordingly, the core wire 10 is not in contact with the terminal member 20 outside the sealing portion 30.

The core wire 10 is joined to the terminal member 20 in the joining portion 21. Moreover, the core wire 10 has a solid portion 12 in which the wires 11 are joined together, in a region where the wires 11 cover the opening portion 31. Joining of the wires 11 together allows the solid portion 12 to reduce entrance of water from the outside.

Figure 4:
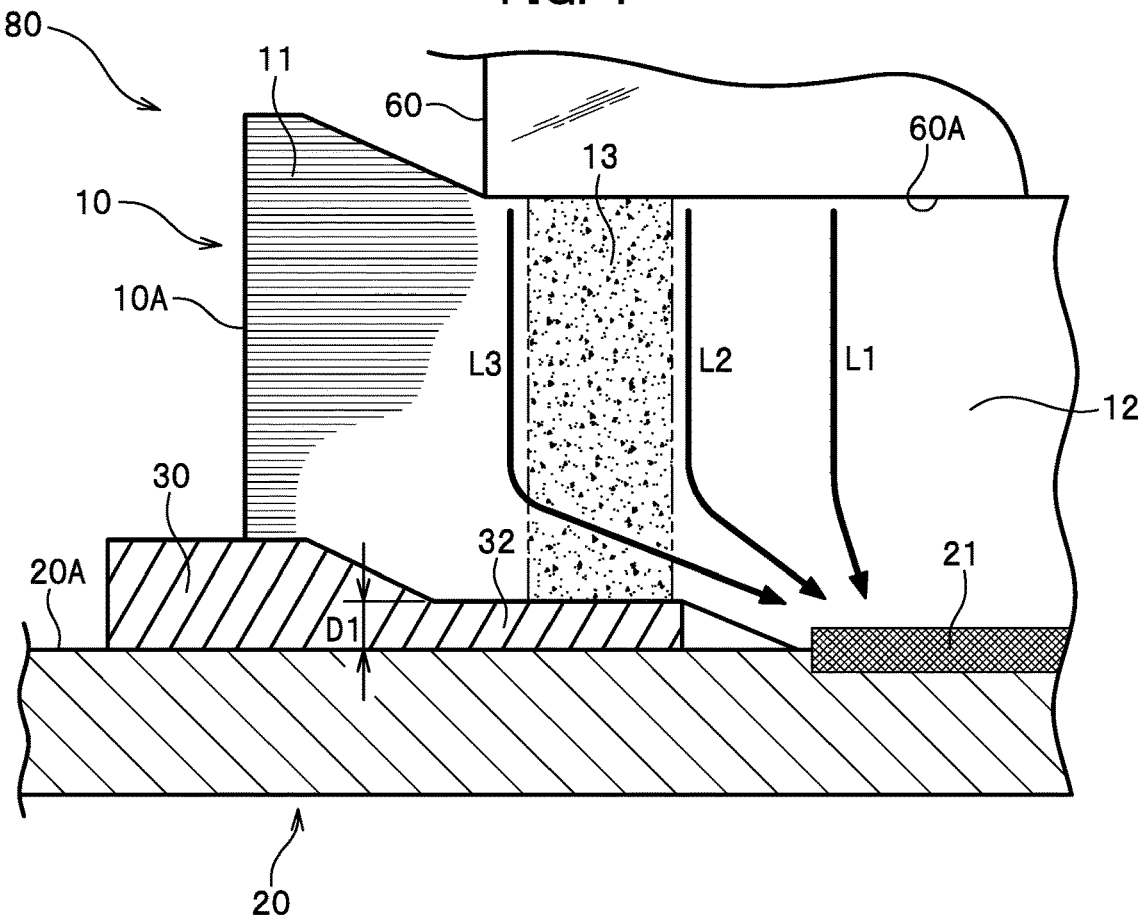
FIG. 4 is a partially enlarged view of FIG. 3C.

As illustrated in FIG. 4, in an outer peripheral portion 13 that is part of the solid portion 12 and that is located in an outer periphery of the solid portion 12, a thickness in a direction perpendicular to the arrangement surface 20A is smaller than a thickness at the position of the joining portion 21 by the thickness D1 of the compressed portion 32 of the sealing portion 30. In a cross section perpendicular to an extending direction of the core wire 10, the number of wires 11 per unit cross-sectional area at the outer peripheral portion 13 is larger than that at around a center portion of the solid portion 12. The density of the wires 11 joined together at the outer peripheral portion 13 is higher than that at around a center portion of the solid portion 12. Accordingly, this allows the outer peripheral portion 13 to further reduce entrance of water from the outside.

[Manufacturing Method]

Next, a manufacturing method of the terminal structure 1 according to the embodiment is described. The manufacturing method of the terminal structure 1 includes: a process S1 of sealing portion arrangement for arranging the sealing portion 30 on the terminal member 20 to be attached to the electric wire 50, the sealing portion 30 having the opening portion 31 surrounding and exposing a region 21R to be provided with the joining portion 21 to be joined to the core wire 10 of the electric wire 50; a process S2 of core wire arrangement for arranging the core wire 10 on the terminal member 20 on which the sealing portion 30 is arranged such that the core wire 10 covers the opening portion 31 and overlaps the sealing portion 30 annularly around the opening portion 31; and a process S3 of joining for pushing the core wire 10 toward the terminal member 20 with a surface that emits a ultrasonic wave to join the core wire 10 to the terminal member 20 through the opening portion 31 and to bring the core wire 10 and the sealing portion 30 into close contact with each other annularly around the opening portion 31.

(Process S1 of Sealing Portion Arrangement)

Figure 3A:
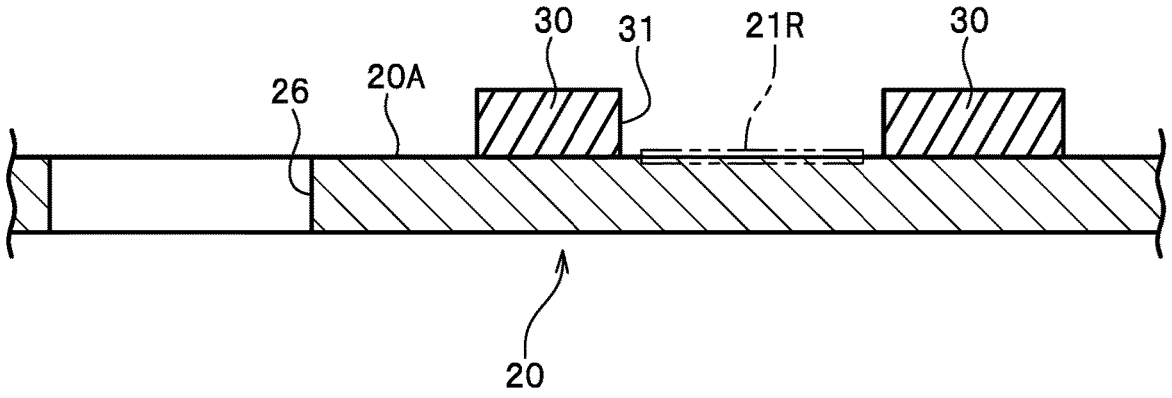
FIG. 3A is a cross-sectional view along the line IIIA-IIIA in FIG. 2 and illustrating a process of sealing portion arrangement in a manufacturing method of the terminal structure according to the embodiment.

The process S1 is a step of arranging the sealing portion 30 on the arrangement surface 20A of the terminal member 20. As illustrated in FIGS. 2 and 3A, the sealing portion 30 is arranged to include the opening portion 31 that surrounds the region 21R provided with the joining portion 21 in which the terminal member 20 and the core wire 10 are joined to each other and that includes the region 21R, provided with the joining portion 21, exposed.

Note that the opening portion 31 is formed to have a size larger than that of the joining portion 21 and smaller than that of a contact surface 60A of a horn 60 to be described later.

(Process S2 of Core Wire Arrangement)

The process S2 is a step of arranging the core wire 10 on the arrangement surface 20A of the terminal member 20.

Figure 3B:
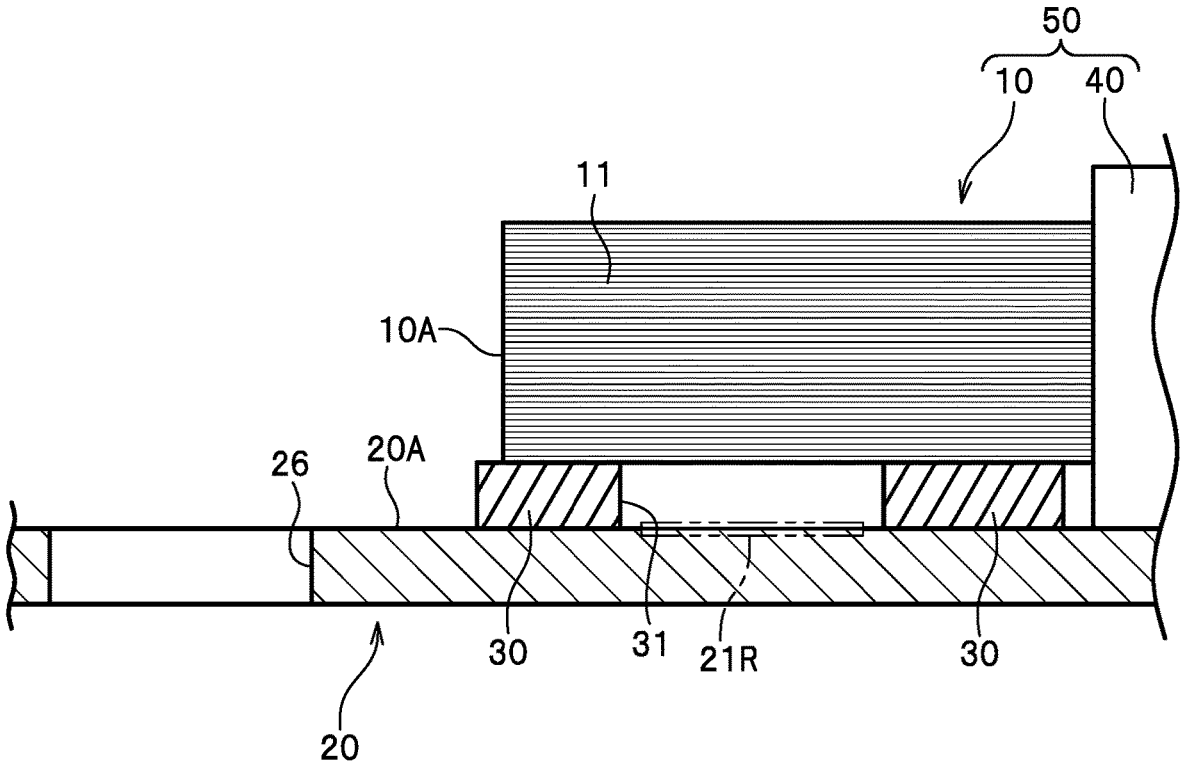
FIG. 3B is a cross-sectional view illustrating a process of core wire arrangement in the manufacturing method of the terminal structure according to the embodiment.

As illustrated in FIG. 3B, the core wire 10 is arranged to overlap the terminal member 20 and the sealing portion 30 to hold the sealing portion 30 between itself and the terminal member 20.

The core wire 10 is arranged to cover the opening portion 31 and overlap the sealing portion 30 annularly around the opening portion 31. In this case, the opening portion 31 is included inside the outer edge of the core wire 10 in the top view. Moreover, as illustrated in FIG. 1A, the outer edges of the front end portion 10A and the side surface portions 10B of the core wire 10 are located inside the outer edge of the sealing portion 30.

(Process S3 of Joining)

The process S3 is a step of performing ultrasonic joining while bringing the horn 60 that emits an ultrasonic wave of a predetermined frequency into contact with the core wire 10 and pushing the core wire 10. The predetermined frequency is, for example, 30 kHz. In the process S3, the core wire 10 is joined to the terminal member 20 through the opening portion 31 to form the joining portion 21 and to bring the core wire 10 and the sealing portion 30 into close contact with each other annularly around the opening portion 31.

Figure 3C:
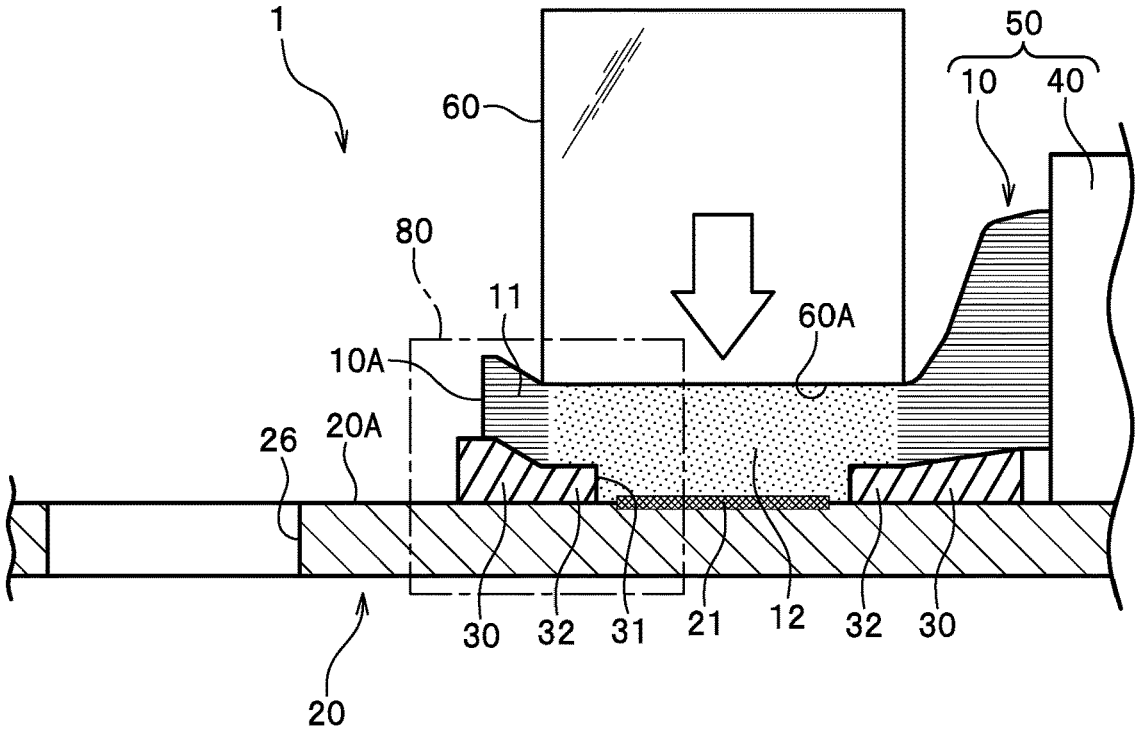
FIG. 3C is a cross-sectional view illustrating a process of joining in the manufacturing method of the terminal structure according to the embodiment.

In the process S3, as illustrated in FIG. 3C, the contact surface 60A of the horn 60 that emits the ultrasonic wave is pressed against the core wire 10 and is pushed toward the terminal member 20. The horn 60 is disposed such that the contact surface 60A is included inside the outer edge of the core wire 10 and the opening portion 31 is included inside the outer edge of the contact surface 60A in the top view.

FIG. 4 illustrates a portion 80 around the front end portion 10A of the core wire 10 in a state where the horn 60 is in contact with the core wire 10 as illustrated in FIG. 3C, in an enlarged manner. The arrows L1, L2, and L3 illustrate examples of directions in which the ultrasonic wave is transmitted. The ultrasonic wave from the horn 60 reaches the joining portion 21 while having the wires 11 joined together. The wires 11 joined together form the solid portion 12. Moreover, the sealing portion 30 pushed via the core wire 10 forms the compressed portion 32. The outer peripheral portion 13 is formed at a position between the horn 60 and the compressed portion 32 in the solid portion 12. The thickness of the outer peripheral portion 13 in the direction perpendicular to the arrangement surface 20A is smaller than the thickness at the position of the joining portion 21 by the thickness D1 of the compressed portion 32 of the sealing portion 30. Accordingly, the density of the wires 11 is increased and, in the cross section perpendicular to the extending direction of the core wire 10, the number of wires 11 per unit cross-sectional area at the outer peripheral portion 13 is larger than that at the center portion of the solid portion 12.

In the process S3, performing the ultrasonic joining in the state where the sealing portion 30 is held between the terminal member 20 and the core wire 10 enables the terminal structure 1 to be manufactured in one ultrasonic joining operation.

The terminal structure 1 according to the present invention is basically configured as described above. Next, operations and beneficial effects of the terminal structure 1 are described.

The terminal structure 1 according to the present invention includes the electric wire 50 including the core wire 10 and the terminal member 20 attached to the electric wire 50. The terminal member 20 includes the joining portion 21 to which the core wire 10 is joined and the sealing portion 30 surrounding the joining portion 21 and including the opening portion 31 having the joining portion 21 exposed therethrough. The core wire 10 is joined to the joining portion 21 through the opening portion 31 and is in close contact with the sealing portion 30 annularly around the opening portion 31.

According to this configuration, in the terminal structure 1, the terminal member 20 includes the joining portion 21 to which the core wire 10 is joined and the sealing portion 30 surrounding the joining portion 21 and including the opening portion 31 having the joining portion 21 exposed therethrough. This allows the sealing portion 30 to be arranged at a position where the sealing portion 30 surrounds only the joining portion 21 to be waterproofed. Moreover, the core wire 10 is joined to the joining portion 21 through the opening portion 31 and is in close contact with the sealing portion 30 annularly around the opening portion 31. This reduces the case where the joining portion 21 is covered with water from the periphery of the opening portion 31.

In the terminal structure 1 according to the present invention, the core wire 10 may include the line of the wires 11 twisted together and the wires 11 are joined together in the region where the wires 11 cover the opening portion 31.

In this configuration, the wires 11 twisted together are joined together in the region where the wires 11 cover the opening portion 31 to fill gaps among the wires 11 and allow the core wire 10 itself to reduce entrance of water into the joining portion 21 from the outside. Accordingly, a waterproofing member is unnecessary in the region where the wires 11 are joined together and this reduces the number of members and the man-hour and achieves size reduction of the terminal.

In the terminal structure 1 according to the present invention, the end portion of the core wire 10 may be located inside the outer edge of the sealing portion 30.

In this configuration, the end portion of the core wire 10 is located inside the outer edge of the sealing portion 30 to reduce contact between the core wire 10 and the terminal member 20 outside the sealing portion 30, and thus reduces electric corrosion.

The terminal structure 1 does not need a waterproofing cover that covers the terminal member, and this achieves size reduction of the terminal. Moreover, it is possible to reduce limitations relating to the shape of the terminal member such as the terminal member being long and improve the degree of freedom in the arrangement of the electric wire. The terminal structure 1 reduces the number of waterproofing members and the man-hours and effectively reduces electric corrosion even if the terminal member 20 and the core wire 10 are made of different types of metals.

The terminal structure 1 according to the embodiment has been described above. Meanwhile, the present invention is not limited to the embodiment and changes are made appropriately within a scope not departing from the object of the present invention.

For example, the core wire 10 may be a single wire. When the core wire 10 is a single wire, the shape of the arrangement surface 20A may be a shape matching the outer surface shape of the core wire 10.

What is claimed is:

1. A terminal structure comprising:

an electric wire including a core wire; and a terminal member attached to the electric wire, wherein the terminal member includes:

a joining portion to which the core wire is joined; and a sealing portion surrounding the joining portion and including an opening portion through which the joining portion is exposed, and the core wire is joined to the joining portion through the opening portion and is in close contact with the sealing portion annularly around the opening portion.

2. The terminal structure according to claim 1, wherein the core wire includes a line of wires twisted together, and the wires are joined together in a region where the wires cover the opening portion.

3. The terminal structure according to claim 1, wherein the core wire includes an end portion located inside an outer edge of the sealing portion.

* * * * *